US007990363B2

(12) United States Patent
Tseng

(10) Patent No.: US 7,990,363 B2
(45) Date of Patent: Aug. 2, 2011

(54) COMMON VOLTAGE ADJUSTING METHOD FOR LIQUID CRYSTAL DISPLAY

(75) Inventor: Yaw-Shing Tseng, Miao-Li (TW)

(73) Assignee: Chimei Innolux Corporation, Miao-Li County (TW)

( * ) Notice: Subject to any disclaimer, the term of this patent is extended or adjusted under 35 U.S.C. 154(b) by 859 days.

(21) Appl. No.: 11/999,074

(22) Filed: Dec. 3, 2007

(65) Prior Publication Data

US 2008/0129721 A1 Jun. 5, 2008

(30) Foreign Application Priority Data

Dec. 1, 2006 (TW) ..... 95144729 A

(51) Int. Cl.
*G09G 3/36* (2006.01)

(52) U.S. Cl. ..... 345/103; 345/99

(58) Field of Classification Search ..... 345/87, 345/88, 94, 96, 208, 212; 348/180, 184, 348/497
See application file for complete search history.

(56) References Cited

U.S. PATENT DOCUMENTS 6,593,921 B2 * 7/2003 Nakanishi et al. ..... 345/208
2005/0276502 A1 * 12/2005 Brown Elliott et al. ..... 382/254
2006/0221044 A1 * 10/2006 Negley et al. ..... 345/102

FOREIGN PATENT DOCUMENTS

CN 1632647 A 6/2005

* cited by examiner

*Primary Examiner* — Quan-Zhen Wang
*Assistant Examiner* — Calvin C Ma
(74) *Attorney, Agent, or Firm* — Wei Te Chung

(57) ABSTRACT

An exemplary common voltage adjusting method for a liquid crystal display (LCD) (20) includes: providing a positive high level voltage to two sub-pixels of a first pixel unit and providing a negative high level voltage to the other sub-pixel of the first pixel unit in a first frame; inspecting the first pixel unit and generating a first color parameter; providing a negative high level voltage to the two sub-pixels of a second pixel unit and providing a positive high level voltage to the other sub-pixel of the second pixel unit in a second frame; inspecting the second pixel unit and generating a second color parameter; generating a common voltage adjusting parameter according to a comparison result of the first color parameter with the second color parameter; and adjusting a common voltage of the LCD according to the common voltage adjusting parameter for confirming a preferred common voltage.

20 Claims, 4 Drawing Sheets

COMMON VOLTAGE ADJUSTING METHOD FOR LIQUID CRYSTAL DISPLAY

FIELD OF THE INVENTION

The present invention relates to a common voltage adjusting method for liquid crystal displays (LCDs), for confirming a preferred common voltage of the LCD.

GENERAL BACKGROUND

A typical LCD has the advantages of portability, low power consumption, and low radiation. LCDs have been widely used in various portable information products, such as notebooks, personal digital assistants (PDAs), video cameras and the like. Furthermore, the LCD is considered by many to have the potential to completely replace CRT (cathode ray tube) monitors and televisions.

Referring to FIG. 4, a typical LCD 10 includes an LCD panel (not labeled), a gate driving circuit 11, and a data driving circuit 12. The LCD panel includes a first substrate (not shown), a second substrate (not shown), and a liquid crystal layer (not shown) sandwiched between the two substrates.

The first substrate includes a number of gate lines 13 that are parallel to each other and that each extend along a first direction, and a number of data lines 14 that are parallel to each other and that each extend along a second direction orthogonal to the first direction. The smallest rectangular area formed by any two adjacent gate lines 13 together with any two adjacent data lines 14 defines a pixel unit 16 thereat. The gate driving circuit 11 is configured for providing a number of scanning signals to the gate lines 13. The data driving circuit 14 is configured for providing a number of gradation voltages to the data lines 14.

In each pixel unit 16, a TFT 15 is provided in the vicinity of a respective point of intersection of one of the gate lines 13 and one of the data lines 14. The TFT 15 functions as a switching element. A pixel electrode 151 is connected to the TFT 15. The second substrate includes a number of common electrodes 152, each common electrode corresponding to a respective one of the pixel electrodes 151 on the first substrate.

When the LCD 10 works, gradation voltages are applied to the pixel electrodes 15 and a common voltage is applied to the common electrodes 152. Thus an electric field is generated and applied to liquid crystal molecules of the liquid crystal layer. At least some of the liquid crystal molecules change their orientations, whereby the liquid crystal layer provides anisotropic transmittance of light therethrough. Thus the amount of the light penetrating the second substrate is adjusted by controlling the strength of the electric field. In this way, desired pixel colors are obtained at the second substrate, and the arrayed combination of the pixel colors provides an image viewed on LCD panel of the LCD 10.

If the electric field between the pixel electrodes 151 and the common electrodes 152 continues to be applied to the liquid crystal material in one direction, the liquid crystal material may deteriorate. Therefore, in order to avoid this problem, gradation voltages that are provided to the pixel electrodes 151 are switched from a positive value to a negative value with respect to the common voltage. This technique is referred to as an inversion drive method.

The inversion drive method needs the common voltage to be a predetermined constant value in order to prevent a flicker phenomenon from appearing on the screen of the LCD 10. Thus a common voltage adjusting method is needed.

However, a typical common voltage adjusting method needs a human operator to alter the common voltage according to a degree of the flicker phenomenon. In other words, the operator needs to personally detect the flicker phenomenon of the LCD 10, and then adjust the common voltage according to the degree of the flicker phenomenon present as judged by the operator himself/herself. Thus, the adjusting procedure for suppressing the flicker phenomenon is subject to human error.

It is desired to provide a common voltage adjusting method for an LCD which can overcome the above-described deficiencies.

SUMMARY

In one preferred embodiment, a common voltage adjusting method for a liquid crystal display (LCD) is provided. The LCD includes a gate driving circuit, a data driving circuit, a plurality of gate lines parallel to each other, a plurality of data lines parallel to each other and orthogonal to the gate lines, a plurality of pixel units each comprising a red sub-pixel, a blue sub-pixel, and a green sub-pixel defined by the gate lines and the data lines. The common voltage adjusting method includes: providing a positive high level voltage to two sub-pixels of a first pixel unit and providing a negative high level voltage to the other sub-pixel of the first pixel unit via data lines when the corresponding gate lines are scanned by a number of scanning signals in a first frame; inspecting the first pixel unit by a first color sensor device and generating a second color parameter; providing a negative high level voltage to two sub-pixels of a second pixel unit and providing a positive high level voltage to the other sub-pixel of the second pixel unit via data lines when the corresponding gate lines are scanned by a number of scanning signals in a second frame; inspecting the second pixel unit by a second color sensor device and generating a second color parameter; and generating a common voltage adjusting parameter according to a comparison result of the first color parameter with the second color parameter; and adjusting a common voltage of the LCD according to the common voltage adjusting parameter for confirming a preferred common voltage.

Other novel features and advantages will become more apparent from the following detailed description when taken in conjunction with the accompanying drawings.

DETAILED DESCRIPTION OF PREFERRED EMBODIMENTS

Reference will now be made to the drawings to describe various embodiments of the present invention in detail.

Figure 1:
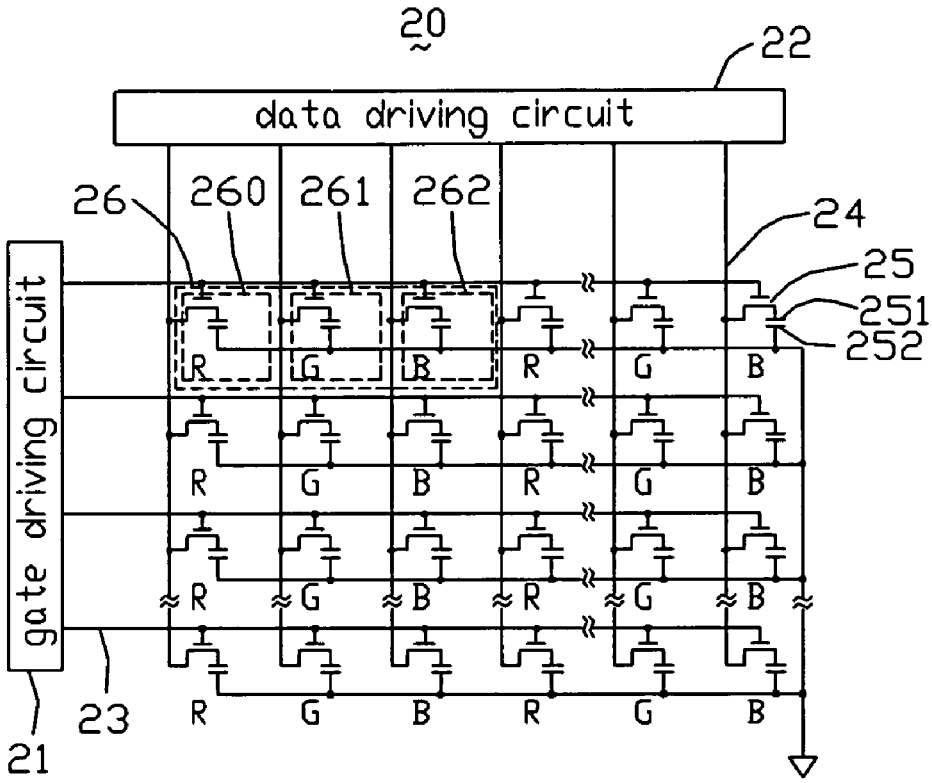
FIG. 1 is essentially an abbreviated circuit diagram of an LCD, wherein the LCD can utilize a common voltage adjusting method according to an exemplary embodiment of the present invention.

Referring to FIG. 1, an LCD 20 includes an LCD panel (not labeled), a gate driving circuit 21, and a data driving circuit 22. The LCD panel includes a first substrate (not shown), a second substrate (not shown), and a liquid crystal layer sandwiched between the two substrates.

The first substrate includes a number of gate lines 23 that are parallel to each other and that each extend along a first direction, and a number of data lines 24 that are parallel to each other and that each extend along a second direction orthogonal to the first direction. The smallest rectangular area formed by any two adjacent gate lines 23 together with any two adjacent data lines 24 defines a sub-pixel thereat. The plurality of sub-pixels thus defined includes a number of red sub-pixels 260, a number of green sub-pixels 261, and a number of blue-sub-pixels 262 arranged in a regular sub-pixel array. In each row of the sub-pixel array, the red, green and blue sub-pixels 260, 261, 262 are sequentially arranged along the first direction in that order. A red sub-pixel 260, a green sub-pixel 261 and a blue-sub-pixel 262 arranged sequentially along the first direction define one pixel unit 26. The gate driving circuit 21 is configured for providing a number of scanning signals to the gate lines 23. The data driving circuit 24 is configured for providing a number of gradation voltages to the data lines 24.

In each sub-pixel 260, 261, 262, a TFT 25 is provided in the vicinity of a respective point of intersection of one of the gate lines 23 and one of the data lines 24. The TFT 25 functions as a switching element. A pixel electrode 251 is connected to the TFT 25. The second substrate includes a number of common electrodes 252, each common electrode 252 corresponding to a respective one of the pixel electrodes 251 on the first substrate.

Figure 2:
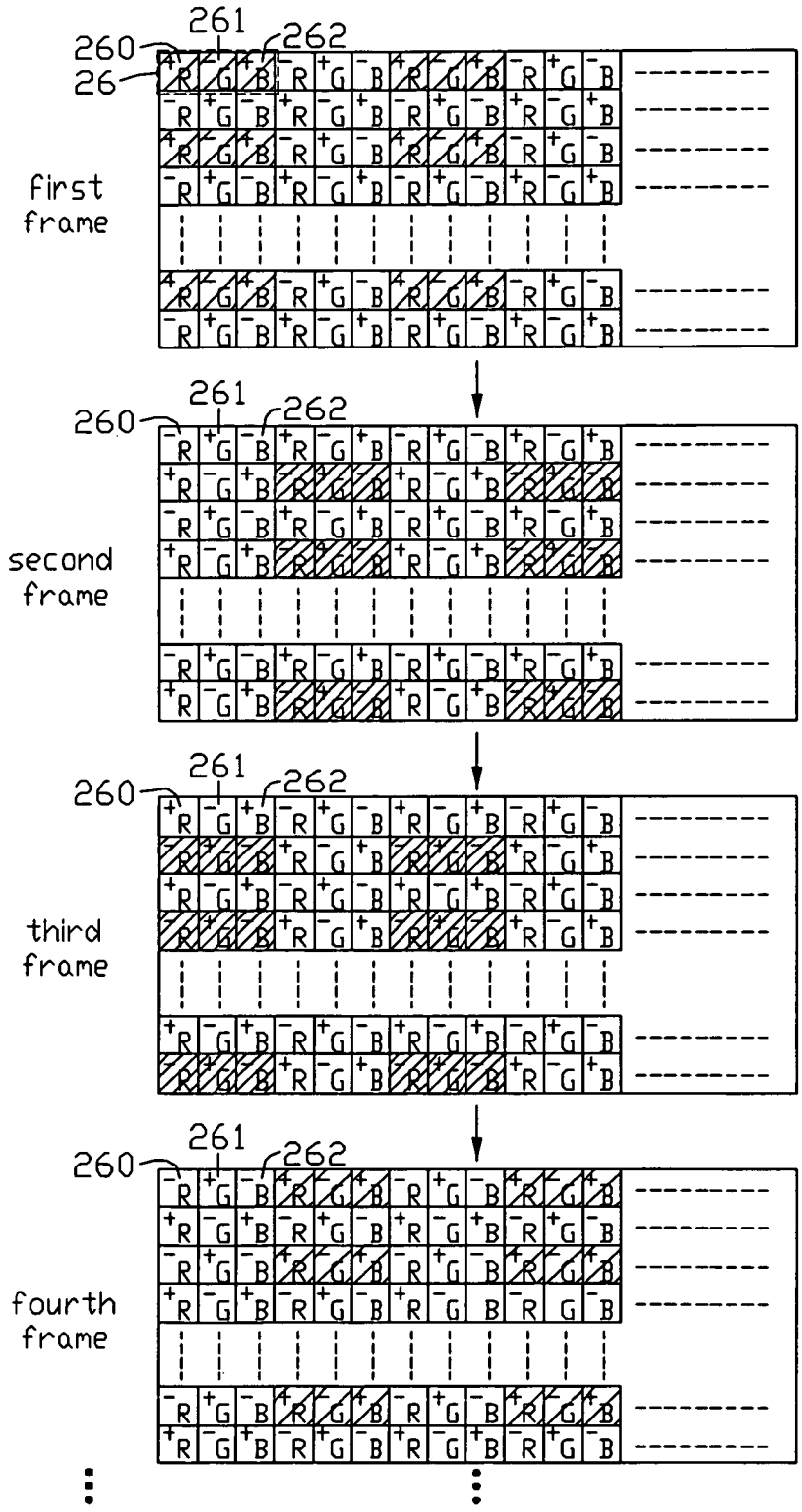
FIG. 2 a flow diagram relating to the common voltage adjusting method of the exemplary embodiment, showing an abbreviated view of sub-pixels of the LCD of FIG. 1 in each of successive frames.

A common voltage adjusting method according to an exemplary embodiment of the present invention can be carried out in the LCD 20. According to the common voltage adjusting method, the LCD 20 is driven by a dot inversion drive method and a frame rate control (FRC) method, as shown in FIG. 2.

Figure 3:
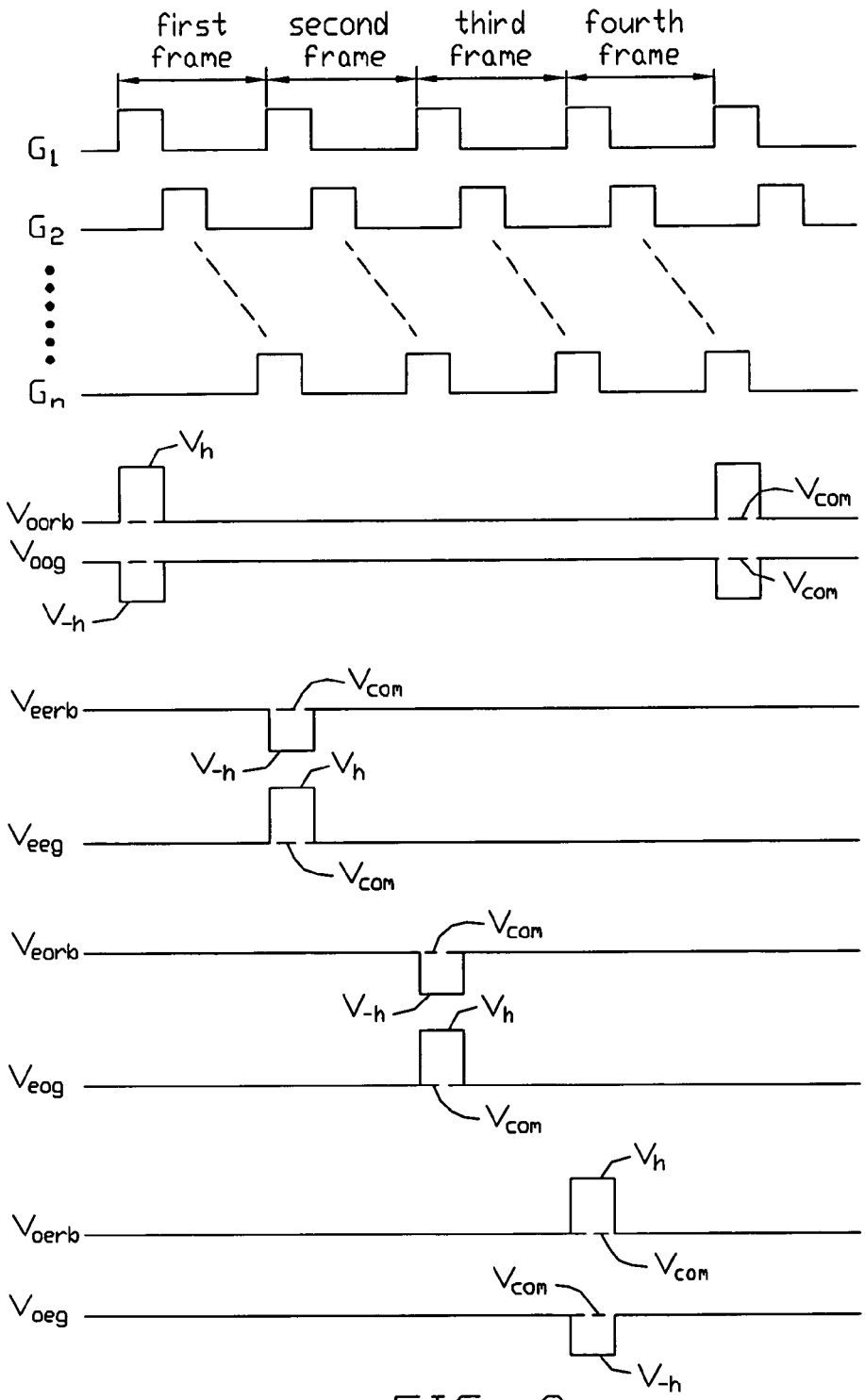
FIG. 3 is an abbreviated waveform diagram of driving signals of the LCD of FIG. 1, the driving signals generated in carrying out the common voltage adjusting method of the exemplary embodiment.
Figure 4:
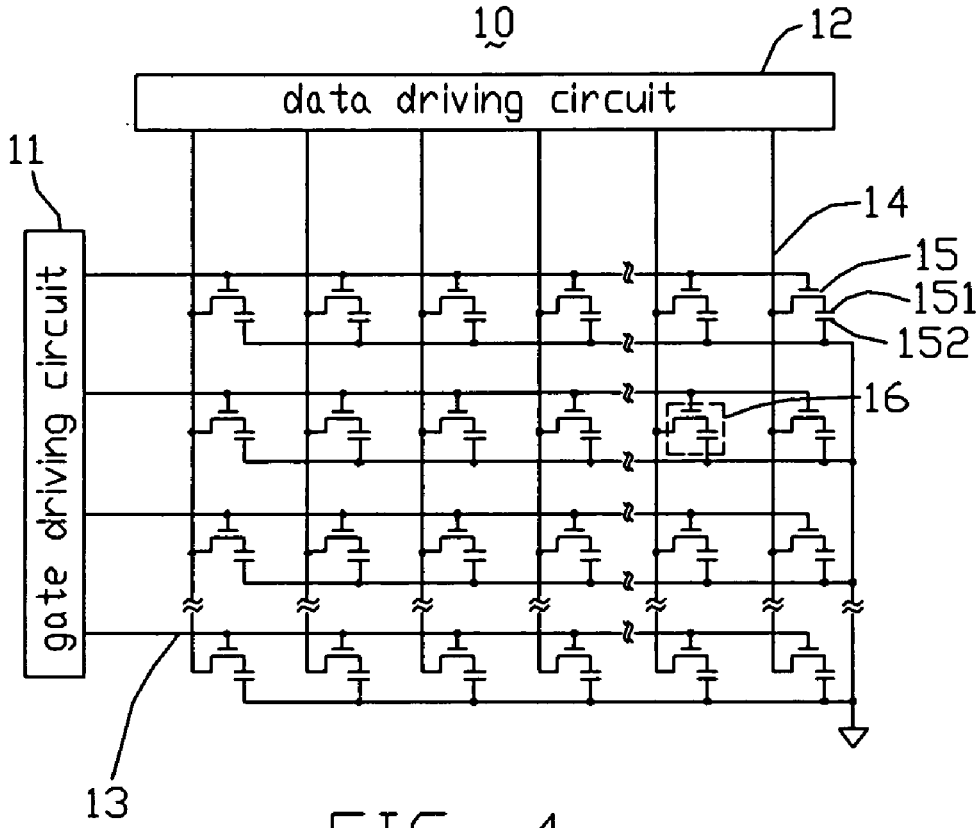
FIG. 4 (RELATED ART)
FIG. 4 is essentially an abbreviated circuit diagram of a conventional LCD.

Referring also to FIG. 3, an abbreviated waveform diagram of driving signals of the LCD 20 is shown. In the chart, the x-axis (not shown) represents time, and the y-axis (not shown) represents voltage. $G_1$-$G_N$ show waveforms of a number of scanning signals provided by the gate driving circuit 21.

$V_{oorb}$ represents a first gradation voltage applied to the red sub-pixels 260 and the blue sub-pixels 262 of the pixel units 26 in odd-numbered rows and odd-numbered columns of a pixel matrix formed by the pixel units 26. $V_{eerb}$ represents a second gradation voltage applied to the red sub-pixels 260 and the blue sub-pixels 262 of the pixel units 26 in even-numbered rows and even-numbered columns of the matrix. $V_{eorb}$ represents a third gradation voltage applied to the red sub-pixels 260 and the blue sub-pixels 262 of the pixel units 26 in even-numbered rows and odd-numbered columns of the matrix. $V_{oerb}$ represents a fourth gradation voltage applied to the red sub-pixels 260 and the blue sub-pixels 262 of the pixel units 26 in odd-numbered rows and even-numbered columns of the matrix.

$V_{oog}$ represents a fifth gradation voltage applied to the green sub-pixels 261 of the pixel units 26 in odd-numbered rows and odd-numbered columns of the matrix. $V_{eeg}$ represents a sixth gradation voltage applied to the green sub-pixels 261 of the pixel units 26 in even-numbered rows and even-numbered columns of the matrix. $V_{eog}$ represents a seventh gradation voltage applied to the green sub-pixels 261 of the pixel units 26 in even-numbered rows and odd-numbered columns of the matrix. $V_{oeg}$ represents an eighth gradation voltage applied to the green sub-pixels 261 of the pixel units 26 in odd-numbered rows and even-numbered columns of the matrix. $V_{com}$ represents a preferred common voltage of the common electrodes 252. The first, fourth, sixth and seventh gradation voltages $V_{oorb}$, $V_{oerb}$, $V_{eeg}$ and $V_{eog}$ are approximately equal to positive high level voltages $V_h$ compared to the preferred common voltage $V_{com}$. The second, third, fifth and eighth gradation voltages $V_{eerb}$, $V_{eorb}$, $V_{oog}$ and $V_{oeg}$ are approximately equal to negative high level voltages $V_{-h}$ compared to the preferred common voltage $V_{com}$.

Operation of the LCD 20 is described in detail as follows. In a first frame, the gate driving circuit 21 generates a number of scanning signals and sequentially provides the scanning signals to the gate lines 23. When the scanning signals are provided to the gate electrodes of the TFTs 25 via the gate lines 23, the TFTs 25 connected to the gate lines 23 are switched on. At the same time, when the odd-numbered gate lines 23 are scanned, a positive high level voltage $V_h$ is provided to the pixel electrodes 151 of the red sub-pixels 260 and the blue sub-pixels 262 of the pixel units 26 in odd-numbered columns of the matrix via the data lines 24 and the activated TFTs 25 in series, and a negative high level voltage $V_{-h}$ is provided to the pixel electrodes 151 of the green sub-pixels 261 of the corresponding pixel units 26 in odd-numbered columns of the matrix. When the even-numbered gate lines 23 are scanned, no gradation voltage is provided to the data lines 24.

If a common voltage (not shown) provided to the common electrodes 252 is slightly greater than the preferred common voltage $V_{com}$, a first voltage difference between the pixel electrodes 251 and common electrodes 252 of the red sub-pixel 260 or the blue sub-pixel 262 is slightly less than $V_h$, and a second voltage difference between the pixel electrodes 251 and common electrodes 252 of the corresponding green sub-pixel 261 is slightly greater than $V_{-h}$. Thus the pixel units 26 in odd-numbered rows and odd-numbered columns display an image in purple when the LCD 20 works in a normal white mode. On the other hand, if the common voltage provided to the common electrodes 252 is slightly less than the preferred common voltage $V_{com}$, the pixel units 26 in odd-numbered rows and odd-numbered columns display an image in green when the LCD 20 works in the normal white mode. In this illustrated embodiment, it is assumed that the common voltage provided to the common electrodes 252 is slightly less than the preferred common voltage $V_{com}$.

The other pixel units 26 excluding the pixel units 26 in odd-numbered rows and odd-numbered columns display an image in white, because no gradation voltage is provided to those pixel units 26 in the first frame.

In a second frame, the gate driving circuit 21 generates a number of scanning signals and sequentially provides the scanning signals to the gate lines 23. When the scanning signals are provided to the gate electrodes of the TFTs 25 via the gate lines 23, the TFTs 25 connected to the gate lines 23 are switched on. At the same time, when the even-numbered gate lines 23 are scanned, a negative high level voltage $V_{-h}$ is provided to the pixel electrodes 251 of the red sub-pixel 260 and the blue sub-pixel 262 of the pixel units 26 in even-numbered columns of the matrix via the data lines 24 and the activated TFTs 25 in series, and a positive high level voltage $V_h$ is provided to the pixel electrodes 251 of the green sub-pixels 261 of the corresponding pixel units 26 in even-numbered columns of the matrix. When the odd-numbered gate lines 23 are scanned, no gradation voltage is provided to the data lines 24.

Because the common voltage provided to the common electrode 252 is less than the preferred common voltage $V_{com}$, a first voltage difference between the pixel electrodes 251 and common electrodes 252 of the red sub-pixels 260 or the blue sub-pixels 262 is slightly less than $V_{-h}$, and a second voltage difference between the pixel electrodes 251 and common electrodes 252 of the corresponding green sub-pixel 261 is slightly greater than $V_h$. Thus the pixel units 26 in even-numbered rows and even-numbered columns display an image in purple since the LCD 20 works in the normal white mode.

The other pixel units 26 excluding the pixel units in even-numbered rows and even-numbered columns display an image in white, because no gradation voltage is provided to those pixel units 26 in the second frame.

In a third frame, the gate driving circuit 21 generates a number of scanning signals and sequentially provides the scanning signals to the gate lines 23. When the scanning signals are provided to the gate electrodes of the TFTs 25 via the gate lines 23, the TFTs 25 connected to the gate lines 23 are switched on. At the same time, when the even-numbered gate lines are scanned, a negative high level voltage $V_{-h}$ is provided to the pixel electrodes 251 of the red sub-pixels 260 and the blue sub-pixels 262 of the pixel units 26 in odd-numbered columns of the matrix via the data lines 24 and the activated TFTs 25 in series, and a positive high level voltage $V_h$ is provided to the pixel electrodes 251 of the green sub-pixels 261 of the corresponding pixel units 26 in odd-numbered columns of the matrix. When the odd-numbered gate lines 23 are scanned, no gradation voltage is provided to the data lines 24.

Because the common voltage provided to the common electrode 252 is less than the preferred common voltage $V_{com}$, a first voltage difference between the pixel electrodes 251 and common electrodes 252 of the red sub-pixels 260 or the blue sub-pixels 262 is slightly less than $V_{-h}$, and a second voltage difference between the pixel electrodes 251 and common electrodes 252 of the corresponding green sub-pixels 261 is slightly greater than $V_h$. Thus the pixel units 26 in even-numbered rows and odd-numbered columns display an image in purple when the LCD 20 works in the normal white mode.

The other pixel units 26 excluding the pixel units in even-numbered rows and odd-numbered columns display an image in white, because no gradation voltage is provided to those pixel units 26 in the third frame.

In a fourth frame, the gate driving circuit 21 generates a number of scanning signals and sequentially provides the scanning signals to the gate lines 23. When the scanning signals are provided to the gate electrodes of the TFTs 25 via the gate lines 23, the TFTs 25 connected to the gate lines 23 are switched on. At the same time, when the odd-numbered gate lines are scanned, a positive high level voltage $V_h$ is provided to the pixel electrodes 251 of the red sub-pixels 260 and the blue sub-pixels 262 of the pixel units 26 in even-numbered columns of the matrix via the data lines 24 and the activated TFTs 25 in series, and a negative high level voltage $V_{-h}$ is provided to the pixel electrodes 251 of the green sub-pixels 261 of the corresponding pixel units 26 in even-numbered columns of the matrix. When the even-numbered gate lines 23 are scanned, no gradation voltage is provided to the data lines 24.

Because the common voltage provided to the common electrode 252 is less than the preferred common voltage $V_{com}$, a first voltage difference between the pixel electrodes 251 and common electrodes 252 of the red sub-pixels 260 or the blue sub-pixels 262 is slightly greater than $V_h$, and a second voltage difference between the pixel electrodes 251 and the common electrodes 252 of the corresponding green sub-pixels 261 is slightly less than $V_{-h}$. Thus the pixel units 26 in even-numbered rows and odd-numbered columns display an image in green when the LCD 20 works in the normal white mode.

The other pixel units 26 excluding the pixel units in odd-numbered rows and even-numbered columns display an image in white, because no gradation voltage is provided to those pixel units 26 in the fourth frame.

After the fourth frame, the LCD 20 repeats the above-described operation from the first frame to the fourth frame.

The common voltage adjusting method includes the following steps: step b1, providing a first color sensor device and a second color sensor device; step b2, inspecting the LCD 20 in the first frame and the third frame by the first color sensor device when the LCD 20 is driven by the dot inversion drive method and the FRC method, and generating a first color parameter; step b3, inspecting the LCD 20 in the second frame and the fourth frame by the second color sensor device, and generating a second color parameter; step b4, comparing the first color parameter with the second color parameter, and generating a common voltage adjusting parameter according to a result of the comparison of the first color parameter with the second color parameter; and step b5, adjusting the common voltage of the LCD 20 according to the common voltage adjusting parameter. The common voltage adjusting method can be repeated until a preferred common voltage is obtained and confirmed.

Because the common voltage adjusting method uses a first color sensor device and a second color sensor device to generate a common voltage adjusting parameter when the LCD 20 is driven by the dot inversion drive method and the FRC method, the common voltage of the LCD 20 can be automatically adjusted according to the common voltage adjusting parameter. Thus, the adjusting method for suppressing flicker phenomenon is not subject to human error.

In a first alternative embodiment, the common voltage adjusting method includes a further step for sequentially inspecting the LCD 20 after the first, second, third and fourth frames.

In a second alternative embodiment, the first color sensor device only inspects the LCD 20 in the first frame for generating the first color parameter, and the second color sensor only inspects the LCD 20 in the second frame for generating the second color parameter.

In a third alternative embodiment, a number of first color sensor devices are used for respectively inspecting the pixel units 26 of the LCD 20 in the first and fourth frames, for generating a number of first color parameters. Each first color sensor device corresponds to pixel units 26 in an odd-numbered column. A number of second color sensor devices are used for respectively inspecting the pixel units 26 of the LCD 20 in the second and third frames, for generating a number of second color parameters. Each second color sensor device corresponds to the pixel units 26 in an even-numbered column. Then, a common voltage adjusting parameter is generated according to a number of comparison results or an average comparison result according to the first color parameters and the second color parameters. Thus, the common voltage can be adjusted according to the number of comparison results or the average comparison result.

In a fourth alternative embodiment, the LCD 20 can be driven as follows. In a first frame, a positive high voltage $V_h$ is provided to the red sub-pixels 260 and the green sub-pixels 261 or to the blue sub-pixels 262 and the green sub-pixels 261 of the pixel units 26 in odd-numbered rows and even-numbered columns of the pixel matrix formed by the pixel units 26, and a negative high voltage $V_{-h}$ is provided to the corresponding blue sub-pixels 262 or to the red sub-pixels 260 in odd-numbered rows and even-numbered columns of the matrix. In the second frame, the gradation voltages provided to the pixel units 26 in even-numbered rows and even-numbered columns of the matrix have a reverse polarity compared to the gradation voltages provided in the first frame.

In a fifth alternative embodiment, the common voltage adjusting method includes: providing a positive high level voltage to a first pixel unit 26 of the LCD 20 in a first frame; inspecting the first pixel unit 26 by a first color sensor device, and generating a first color parameter; providing a negative high level voltage to a second pixel unit 26 of the LCD 20 in a second frame; inspecting the second pixel unit 26 by a second color sensor device, and generating a second color parameter; comparing the first color parameter with the second color parameter, and generating a common voltage adjusting parameter according to a result of the comparison of the first color parameter with the second color parameter; and adjusting the common voltage of the LCD 20 according to the common voltage adjusting parameter.

In the above alternative embodiments, when a difference between the first color parameter and the second color parameter has a smallest (threshold) value, a preferred common voltage adjusting parameter which corresponds to the smallest degree of the flicker phenomenon can be confirmed. The smallest value can be predefined by a user or operator according to need. Furthermore, a preferred common voltage adjusting parameter which corresponds to the smallest degree of the flicker phenomenon can also be confirmed when the first color parameter or the second color parameter has a smallest (threshold) value. Each of the smallest first color parameter value and the smallest second color parameter value can be predefined by a user or operator according to need.

It is to be understood, however, that even though numerous characteristics and advantages of preferred and exemplary embodiments have been set out in the foregoing description, together with details of the structures and functions of the embodiments, the disclosure is illustrative only; and that changes may be made in detail, especially in matters of arrangement of parts within the principles of the present invention to the full extent indicated by the broad general meaning of the terms in which the appended claims are expressed.

What is claimed is:

1. A common voltage adjusting method for a liquid crystal display (LCD), the LCD comprising a gate driving circuit, a data driving circuit, a plurality of gate lines parallel to each other, a plurality of data lines parallel to each other and orthogonal to the gate lines, and a plurality of pixel units each comprising a red sub-pixel, a blue sub-pixel, and a green sub-pixel defined by the gate lines and the data lines, the pixel units comprising a first pixel unit and a second pixel unit, the method comprising:

providing a positive high level voltage to the red and the blue sub-pixels of the first pixel unit respectively and providing a negative high level voltage to the green sub-pixel of the first pixel unit via corresponding data lines when the corresponding gate lines are scanned by a number of scanning signals in a first frame;

inspecting the first pixel unit by a first color sensor device, and generating a first color parameter in the first frame;

providing a negative high level voltage to the red and the blue sub-pixels of the second pixel unit respectively and providing a positive high level voltage to the green sub-pixel of the second pixel unit via corresponding data lines when the corresponding gate lines are scanned by a number of scanning signals in a second frame;

inspecting the second pixel unit by a second color sensor device, and generating a second color parameter in a second frame;

generating a common voltage adjusting parameter according to a result of a comparison of the first color parameter with the second color parameter;

adjusting a common voltage of the LCD according to the common voltage adjusting parameter, and confirming the adjusted common voltage is a preferred common voltage when a difference of the first color parameter and the second color parameter has a smallest value.

2. The common voltage adjusting method as claimed in claim 1, wherein the LCD is driven by a dot inversion drive method and a frame rate control (FRC) method.

3. The common voltage adjusting method as claimed in claim 2, wherein no gradation voltage is provided to the second pixel unit and the second pixel unit displays a white image in the first frame, and no gradation voltage is provided to the first pixel unit and the first pixel unit displays a white image in the second frame.

4. The common voltage adjusting method as claimed in claim 3, wherein the smallest value is predefined by a user or an operator.

5. The common voltage adjusting method as claimed in claim 1, wherein the first pixel unit is in an odd-numbered row and an odd-numbered column of a matrix formed by the pixel units, and the second pixel unit is in an even-numbered row and an even-numbered column of the matrix.

6. The common voltage adjusting method as claimed in claim 1, further comprising repeating the method recited therein until the preferred common voltage is obtained and confirmed.

7. A common voltage adjusting method for a liquid crystal display (LCD), the LCD comprising a gate driving circuit, a data driving circuit, a plurality of gate lines parallel to each other, a plurality of data lines parallel to each other and orthogonal to the gate lines, and a plurality of pixel units each comprising a red sub-pixel, a blue sub-pixel, and a green sub-pixel defined by the gate lines and the data lines, the plurality of pixel units comprising a plurality of first pixel units and a plurality of second pixel units, the method comprising:

providing a negative high level voltage to the red and the blue sub-pixels of each first pixel unit respectively and providing a positive high level voltage to the green sub-pixel of each first pixel unit via corresponding data lines when the corresponding gate lines are scanned by a number of scanning signals in a first frame;

inspecting the first pixel units by a first color sensor device, and generating a first color parameter in the first frame;

providing a positive high level voltage to the red and the blue sub-pixels of each second pixel unit respectively and providing a negative high level voltage to the green sub-pixel of each second pixel unit via corresponding data lines when the corresponding gate lines are scanned by a number of scanning signals in a second frame;

inspecting the second pixel units by a second color sensor device, and generating a second color parameter in the second frame;

generating a common voltage adjusting parameter according to a result of a comparison of the first color parameter with the second color parameter;

adjusting a common voltage of the LCD according to the common voltage adjusting parameter, and confirming the adjusted common voltage is a preferred common voltage when a difference of the first color parameter and the second color parameter has a smallest value.

8. The common voltage adjusting method as claimed in claim 7, wherein the plurality of pixel units form a matrix, the first pixel units are located at odd-numbered rows and odd-numbered columns of the matrix, and the second pixel units are located at even-numbered rows and even-numbered columns of the matrix.

9. The common voltage adjusting method as claimed in claim 8, wherein the plurality of pixel units further comprising a plurality of third pixel units located at odd-numbered rows and even-numbered columns of the matrix and a plurality of fourth pixel units located at even-numbered rows and odd-numbered columns of the matrix, no gradation voltage is provided to the second, third and fourth pixel units and the second, third and fourth pixel units display white images in the first frame, and no gradation voltage is provided to the first, third and fourth pixel units and the first, third and fourth pixel units display white images in the second frame.

10. The common voltage adjusting method as claimed in claim 9, wherein the smallest value is predefined by a user or an operator.

11. A common voltage adjusting method for a liquid crystal display (LCD), the LCD comprising a gate driving circuit, a data driving circuit, a plurality of gate lines parallel to each other, a plurality of data lines parallel to each other and orthogonal to the gate lines, and a plurality of pixel units each comprising a red sub-pixel, a blue sub-pixel, and a green sub-pixel defined by the gate lines and the data lines, the method comprising:

providing a negative high level voltage to the red and the blue sub-pixels of a plurality of first pixel units corresponding to odd-numbered gate lines and providing a positive high level voltage to the green sub-pixels of the first pixel units via corresponding data lines when the corresponding odd-numbered gate lines are scanned by a plurality of scanning signals in a first frame and a fourth frame;

inspecting the first pixel units by a first color sensor device, and generating a first color parameter in the first frame and the fourth frame;

providing a positive high level voltage to the red and the blue sub-pixels of a plurality of second pixel units corresponding to even-numbered gate lines and providing a negative high level voltage to the green sub-pixels of the second pixel units via corresponding data lines when the corresponding even-numbered gate lines are scanned by a number of scanning signals in a second frame and a third frame;

inspecting the second pixel units by a second color sensor device, and generating a second color parameter in the second frame and the third frame;

generating a common voltage adjusting parameter according to a result of a comparison of the first color parameter with the second color parameter;

adjusting a common voltage of the LCD according to the common voltage adjusting parameter, and confirming the adjusted common voltage is a preferred common voltage when a difference of the first color parameter and the second color parameter has a smallest value.

12. The common voltage adjusting method as claimed in claim 11, wherein the LCD is driven by a dot inversion drive method and a frame rate control (FRC) method.

13. The common voltage adjusting method as claimed in claim 11 wherein the method is performed using a plurality of the first color sensor devices for inspecting the first pixel units and a plurality of the second color sensor devices for inspecting the second pixel units, each first color sensor device corresponding to the pixel units in an odd-numbered row of a matrix formed by the pixel units and generating a first color parameter, each second color sensor device corresponding to the pixel units in an even-numbered row of the matrix and generating a second color parameter.

14. The common voltage adjusting method as claimed in claim 13, wherein the comparison result is an average obtained by comparison of the first color parameters with the second color parameters.

15. The common voltage adjusting method as claimed in claim 11, wherein no gradation voltage is provided to the second pixel unit and the second pixel unit displays a white image in the first frame, and no gradation voltage is provided to the first pixel unit and the first pixel unit displays a white image in the second frame.

16. The common voltage adjusting method as claimed in claim 15, wherein the smallest value is predefined by a user or an operator.

17. A common voltage adjusting method for a liquid crystal display (LCD), the LCD comprising a plurality of gate lines parallel to each other, a plurality of data lines parallel to each other and orthogonal to the gate lines, and a plurality of pixel units each comprising a red sub-pixel, a blue sub-pixel, and a green sub-pixel defined by the gate lines and the data lines, the plurality of pixel units comprising a plurality of first pixel units, a plurality of second pixel units, a plurality of third pixel units, and a plurality of fourth pixel units, the method comprising:

providing a positive high level voltage to the red and the blue sub-pixels of the first pixel units and providing a negative high level voltage to the green sub-pixel of the first pixel units via corresponding data lines respectively when the corresponding gate lines are scanned by a number of scanning signals in a first frame;

providing a negative high level voltage to the red and the blue sub-pixels of the second pixel units and providing a positive high level voltage to the green sub-pixel of the second pixel units via corresponding data lines respectively when the corresponding gate lines are scanned by a number of scanning signals in a second frame;

providing a negative high level voltage to the red and the blue sub-pixels of the third pixel units and providing a positive high level voltage to the green sub-pixel of the third pixel units via corresponding data lines respectively when the corresponding gate lines are scanned by a number of scanning signals in a third frame;

providing a positive high level voltage to the red and the blue sub-pixels of the fourth pixel units and providing a negative high level voltage to the green sub-pixel of the fourth pixel units via corresponding data lines respectively when the corresponding gate lines are scanned by a number of scanning signals in a fourth frame;

inspecting the first and fourth pixel units by a first color sensor device, and generating a first color parameter in the first frame and the fourth frame;

inspecting the second and third pixel units by a second color sensor device, and generating a second color parameter in the second frame and the third frame;

generating a common voltage adjusting parameter according to a result of a comparison of the first color parameter with the second color parameter;

adjusting a common voltage of the LCD according to the common voltage adjusting parameter, and confirming the adjusted common voltage is a preferred common voltage when a difference of the first color parameter and the second color parameter has a smallest value.

18. The common voltage adjusting method as claimed in claim 17, wherein the plurality of pixel units form a matrix, the first pixel units are located at odd-numbered rows and odd-numbered columns of the matrix, the second pixel units are located at even-numbered rows and even-numbered columns of the matrix, the third pixel units are located at even-numbered rows and odd-numbered columns of the matrix, and the fourth pixel units are located at odd-numbered rows and even-numbered columns of the matrix.

19. The common voltage adjusting method as claimed in claim 18, wherein no gradation voltage is provided to the second, third and fourth pixel units and the second, third and fourth pixel units display white images in the first frame, no gradation voltage is provided to the first, third and fourth pixel units and the first, third and fourth pixel units display white images in the second frame, no gradation voltage is provided to the first, second and fourth pixel units and the first, second and fourth pixel units display white images in the third frame, no gradation voltage is provided to the first, second and third pixel units and the first, second and third pixel units display white images in the fourth frame.

20. The common voltage adjusting method as claimed in claim 19, wherein the smallest value is predefined by a user or an operator.

* * * * *